US005212671A

United States Patent [19]

Fujii et al.

[11] Patent Number: 5,212,671

[45] Date of Patent: May 18, 1993

[54] ULTRASONIC PROBE HAVING BACKING MATERIAL LAYER OF UNEVEN THICKNESS

[75] Inventors: Tadashi Fujii; Hiroyuki Yagami, both of Kanagawa, Japan

[73] Assignee: Terumo Kabushiki Kaisha, Japan

[21] Appl. No.: 540,607

[22] Filed: Jun. 19, 1990

[30] Foreign Application Priority Data

Jun. 22, 1989 [JP] Japan ..... 1-160048
Nov. 10, 1989 [JP] Japan ..... 1-291119

[51] Int. Cl.[5] ..... H04R 17/00

[52] U.S. Cl. ..... 367/151; 367/152; 367/157; 310/335

[58] Field of Search ..... 367/152, 157, 160, 161, 367/164, 150, 151; 310/325, 335, 364

[56] References Cited

U.S. PATENT DOCUMENTS

| | | | |
|---|---|---|---|
| 3,703,652 | 11/1972 | Noda | 367/151 |
| 3,948,350 | 4/1976 | Erickson | 367/151 |
| 3,982,142 | 9/1976 | Goble | 367/151 |
| 4,795,935 | 1/1989 | Fujii et al. | 310/336 |
| 4,870,972 | 10/1989 | Maerfield et al. | 126/662.03 |

FOREIGN PATENT DOCUMENTS

| | | |
|---|---|---|
| 0210723 | 2/1980 | European Pat. Off. . |
| 0015886 | 9/1980 | European Pat. Off. . |
| 0142178 | 2/1985 | European Pat. Off. . |
| 62-68000 | 9/1981 | Japan . |
| 58-29455 | 2/1983 | Japan . |
| 58-22040 | 3/1983 | Japan . |
| 58-131559 | 5/1983 | Japan . |
| 58-73861 | 12/1983 | Japan . |
| 58-188992 | 2/1984 | Japan . |
| 59-23678 | 4/1984 | Japan . |
| 63-172600 | 7/1988 | Japan . |
| 63-173954 | 7/1988 | Japan . |
| 63-175761 | 7/1988 | Japan . |
| 63-255044 | 11/1988 | Japan . |
| 1505411 | 3/1978 | United Kingdom . |

OTHER PUBLICATIONS

An extract from Dialog Filed regarding Japanese Patent Laid-Open Publication Nos. 172600/1988, 68000/1987, 73861/1983.

European Search Report dated Jan. 21, 1991 "Design Method and Experimental Result of a Matched Piezoelectric Transducer" by S. Grinderslev, pp. 79-86 vol. 53, No. 2, Jun. 1983, Stuttgart DE.

"New Method of Time Domain Analysis of the Performance of Multilayered Ultrasonic Transducers" from IEEE Transactions vol. UFFC-33, No. 6, Nov. 1986.

*Primary Examiner*—J. Woodrow Eldred

*Attorney, Agent, or Firm*—Beveridge, DeGrandi, Weilacher & Young

[57] ABSTRACT

An ultrasonic probe includes a piezoelectric material layer having a pair of electrodes provided on both main surfaces thereof for applying voltage thereto, and a backing material provided on one electrode. The backing material has an acoustic impedance lower than that of the piezoelectric material layer. Interposed between the backing material and one electrode is an acoustic reflecting material layer which has a thick first portion and a thin second portion. The second portion may have a substantially zero thickness to allow the backing material to be in partial contact with one electrode. Thereby, the ultrasonic probe can transmit and receive ultrasonic waves at its resonance frequencies. Also provided is an ultrasonic diagnostic apparatus which displays an image resultant from combining images having the frequencies obtained by driving the ultrasonic probe.

12 Claims, 10 Drawing Sheets

ULTRASONIC PROBE HAVING BACKING MATERIAL LAYER OF UNEVEN THICKNESS

BACKGROUND OF THE INVENTION

1. Field of the Invention

The present invention relates to an ultrasonic probe, more specifically, a broad-banded ultrasonic probe capable of transmitting and receiving ultrasonic waves having a plurality of frequencies.

2. Description of the Prior Art

Ultrasonic diagnoses have been extensively popularized as image diagnostics of high simplicity, safetiness, and economy and have been spreading the range of the examining subject in almost all the realm of the living body. Especially in the examination of the living body, however, different frequencies must be used depending on subjects to be examined. In the prior art, since the available frequencies are specific to respective ultrasonic probes, multiple kinds of ultrasonic probes are generally required for respective subjects. In the examination of the living body, for example, probes having a high frequency, e.g. 5–10 MHz, for examining the shallow regions and ones having a low frequency, e.g. 3.5–5 MHz, for examining the deeper regions. As stated above, it has been an inconvenience that probes having different frequencies have to be selected for use depending on subjects to be examined. Consequently, a broad-banded ultrasonic device using a single probe capable of transmitting and receiving various frequencies from low frequencies to high frequencies is now strongly called for.

Up to the present, several types of ultrasonic probes capable of transmitting and receiving a plurality of frequencies have been invented. For example, there are a type laminated with piezoelectric transducers each having different resonant frequency as taught in the Japanese patent laid-open publication Nos. 73861/1983, 172600/1988, and 173954/1988, a type devised with acoustic matching layers as disclosed in the Japanese patent laid-open publication No. 255044/1988, and a type comprising piezoelectric transducers having different resonant frequencies and alternately arranged as shown and described in the Japanese patent laid-open publication No. 68000/1987.

Any of those types has a defect, such as a complicated structure causing difficulties in manufacture or a narrow band for frequency response. The laminated type of ultrasonic probe, for example, requires to have a structure laminated with as many piezoelectric transducers as the number of different frequencies, causing complexity in manufacture and less economy. Also, with respect to the characteristics, since the laminated type has a structure with piezoelectric transducers having different resonant frequency laminated toward the direction of ultrasonic waves transmitted and received by the probe, the piezoelectric transducers act upon each other to interfere with the ultrasonic wave propagation when the probe transmits and receives ultrasonic waves, resulting in difficulty of obtaining acceptable results.

Further, in the type devised with acoustic matching layers, as the band cannot be widened more than that of the piezoelectric transducer, it is difficult to obtain satisfactory characteristics.

Still further, the type with alternately arrayed piezoelectric transducers having different resonant frequencies can be used in the form of an array type of ultrasonic probe, through the density in array of transducers having the same frequencies is low. Therefore, it is difficult to satisfy the most important requirements, for the array type probe, that the array density of transducers be high and an ultrasonic sound field capable of transmitting and receiving ultrasonic waves having high directivity with the grating lobe suppressed as much as possible be formed, resulting in degradation of the characteristics.

In addition, as a type different from those described above, in the Japanese patent laid-open publication No. 22040/1983 there is proposed an array type of probe in which arranged are the piezoelectric transducers which are continuously different in thickness in the direction perpendicular to the scanning direction to cause the resonant frequencies to continuously differ from each other in that direction. This system, however, also has a great difficulty in manufacture of the above-mentioned piezoelectric transducers and is hard to be put to practical use.

SUMMARY OF THE INVENTION

It is therefore an object of the present invention to provide an ultrasonic probe having comparatively less difficulties in manufacture and a broad frequency bandwidth.

In accordance with the present invention, an ultrasonic probe comprises a layer of piezoelectric material having generally flat main surfaces, a pair of electrodes provided on the main surfaces of the layer of piezoelectric material to apply voltage to the layer of piezoelectric material, and a layer of backing material provided on one of the pair of electrodes and having an acoustic impedance lower than that of the layer of piezoelectric material. The ultrasonic probe further comprises a layer of reflecting material interposed between one of the electrodes and the layer of backing material and having an acoustic impedance higher than that of the layer of piezoelectric material. The layer of reflecting material has a first portion and a second portion which is thinner than the first portion.

In the ultrasonic probe apparatus in accordance with the present invention, a layer of backing material includes a first portion having an acoustic impedance lower than that of a layer of piezoelectric material and a second portion having an acoustic impedance higher than that of the layer of piezoelectric material, both portions of which are arranged on the back surface of the layer of piezoelectric material. Thus, a $\lambda/2$ resonance on the first portion and a $\lambda/4$ resonance on the second portion give rise to the total resonances having different frequencies obtained. Consequently, use of the ultrasonic probe in the ultrasonic diagnostic apparatus makes it possible to obtain by a single kind of ultrasonic probe not only two tomographic images of a subject with different frequencies but also a composite tomographic image resultant from the two tomographic images.

In the ultrasonic probe in accordance with the present invention, the layer of backing material also has an acoustic impedance higher than that of the layer of piezoelectric material and is formed, for example, into a shape with thickness gradually decreasing toward the center of the layer of piezoelectric material. Thereby, the ultrasonic probe apparatus can realize a broad-banded operation capable of continuously covering resonant frequencies from the $\lambda/2$ resonance mode up to the $\lambda/4$ resonance mode. As a result, in all the depths of an subject and an ultrasonic tomographic image with a high S/N ratio can be obtained.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1B:
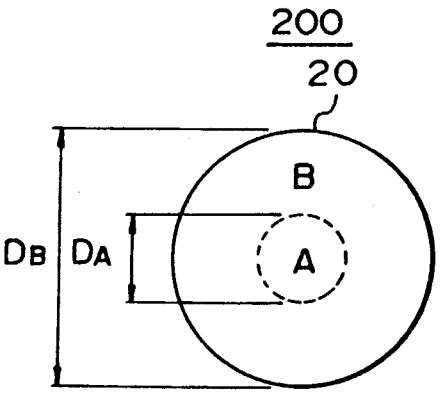
FIG. 1B is a lateral side view of the ultrasonic probe shown in FIG. 1A.
Figure 1A:
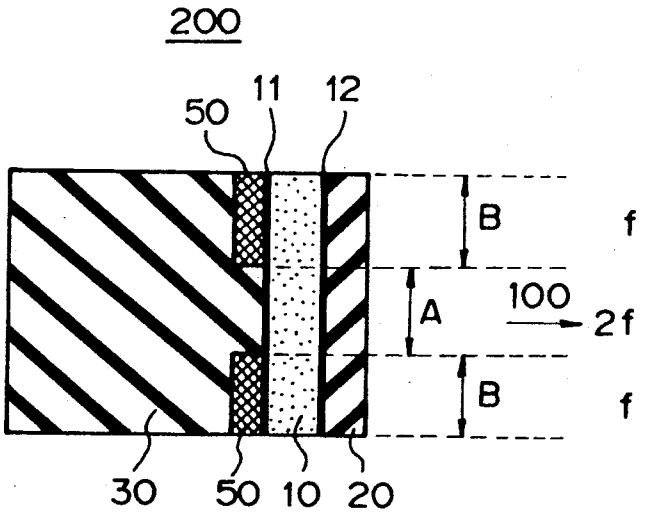
FIG. 1A is a sectional view showing an illustrative embodiment of an ultrasonic probe in accordance with the present invention.

Referring to FIG. 1A, an ultrasonic probe 200 in an illustrative embodiment includes, on the side of a load 100 with respect to a generally circular flat-shaped piezoelectric transducer material 10, an acoustic matching layer 20 with an electrode 12 interposed inbetween, and, on the opposite side, an annular layer of acoustic reflecter 50 and a backing material 30 with an electrode 11 interposed therebetween. The ultrasonic probe 200 is an electric acoustic transducer which transmits ultrasonic waves in response to a frequency voltage applied between the electrodes 11 and 12 and generates frequency voltage between the electrodes 11 and 12 in response to the received ultrasonic waves. The load 100, which is conceptionally indicated with an arrow, is a subject for an ultrasonic diagnosis, such as a living body. As seen in FIG. 1B, brought into contact with the generally circular flat-shaped electrode 11 are the annular acoustic reflecting layer 50 on the circumferential area B and the backing material 30 near the center area A. In addition, assuming that acoustic impedances are represented by $Z_{10}$ for the transducer material 10, $Z_{30}$ for the backing material 30, and $Z_{50}$ for the acoustic reflecting layer 50, respectively, they become in the relation of $Z_{30}<Z_{10}$, $Z_{50}>Z_{10}$. Specifically, the backing material 30 is a layer of backing material having an acoustic impedance lower than that of the piezoelectric material 10, whereas the acoustic reflecting layer 50 is a layer of backing material having an acoustic impedance higher than that of the piezoelectric material 10. If so structured, the center area A and the vicinity thereof on the piezoelectric material 10 vibrate in a $\lambda/2$ resonance mode, while the circumferential area B does in a $\lambda/4$ resonance mode. Where, $\lambda$ is an ultrasonic wavelength. Consequently, the probe 200, as a whole, in the vicinity of the center area A can transmit ultrasonic waves to the load 100 and receive the ultrasonic waves returned from the load 100 in the form of echoes at a frequency twice as high as that of the probe on the circumferential area B.

Consequently, to obtain the most desirable example according to an embodiment shown in FIG. 1A, assuming that the diameter of the circumferential area B is $D_B$ and the diameter of the center area is $D_{AA}$, the acoustic reflecting layer 50 may be formed to be $$D_B=3\times D_A.$$

Figure 2:
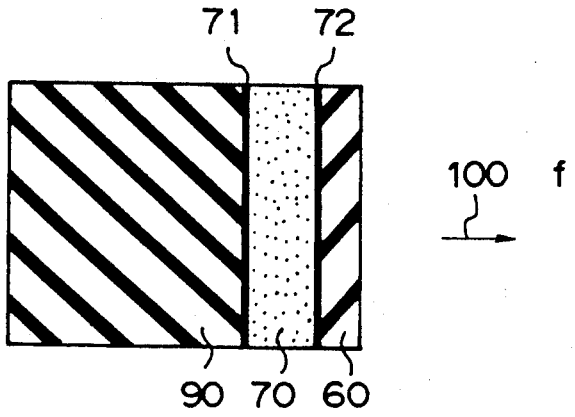
FIGS. 2, 3, and 4 are sectional view showing ultrasonic probes, useful for understanding the theory on which the present invention relies.

Subsequently, the theory of the ultrasonic probe 200 of the present invention will be described hereunder, making reference to FIGS. 2, 3, and 4. FIG. 2 is a sectional view illustrating an ultrasonic probe, called a $\lambda/2$ resonance probe, consisting of a generally circular, flat-shaped piezoelectric transducer material 70, an acoustic matching layer 60 having the same shape as that of the piezoelectric material 70, and a generally cylindrical backing material 90. The ultrasonic probe resonates at a frequency which satisfies a condition that, when the relation between the acoustic impedance $Z_{90}$ of the backing material 90 and the acoustic impedance $Z_{70}$ of the piezoelectric material 70 is $Z_{70}>Z_{90}$, the thickness of the piezoelectric material 70 is equal to $\frac{1}{2}$ of the wavelength $\lambda$, and has the centeral frequency f with a certain narrow bandwidth $f\pm\Delta f$. In this case, the acoustic impedance $Z_{60}$ of the acoustic matching layer 60 is set to be a value falling between the acoustic impedance $Z_{70}$ of the piezoelectric material 70 and the acoustic impedance $Z_{100}$ of the load (the subject) 100. Specifically, it is selected in the range of $Z_{70}>Z_{60}>Z_{100}$ to be ordinarily set to a $\lambda_{100}/4$. Where, a $\lambda_{60}$ is a wavelength involved in the acoustic matching layer 60, and let the acoustic velocity in the acoustic matching layer 60 be $C_{60}$, the relation is $\lambda=C_{60}/f$.

Figure 3:
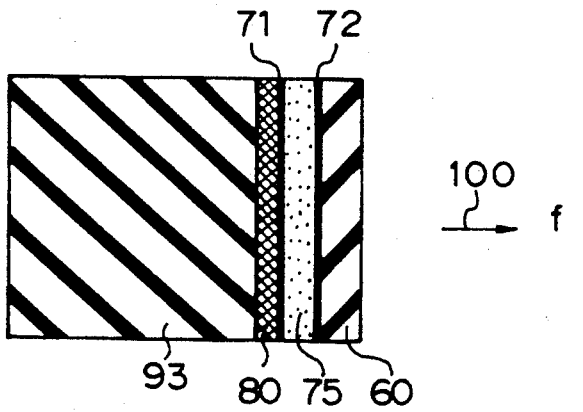
Figure 4:
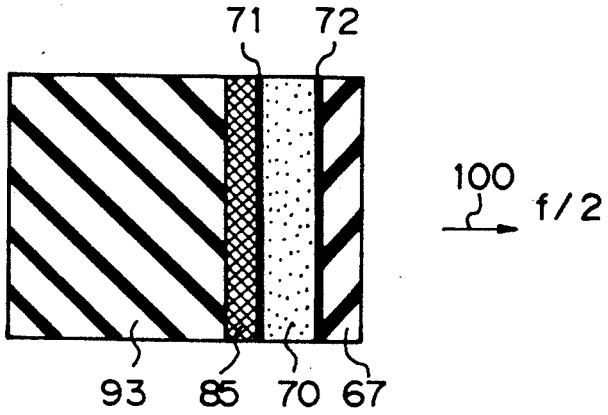

FIG. 3 is a sectional view illustrating the ultrasonic probe called a $\lambda/4$ resonance probe. The ultrasonic probe shown in FIG. 3 differs from the one shown in FIG. 2 in that the piezoelectric material 75 is half as thick as the piezoelectric material 70 shown in FIG. 2. Specifically, the piezoelectric material is set to the $\lambda/4$ resonance. Further, between the backing material 93 and the transducer material 75 there exists an acoustic reflecting layer 80, the acoustic impedance $Z_{80}$ of which is selected to be $Z_{80}>Z_{75}$. The backing material 93 is a member for supporting the acoustic reflecting layer 80. Consequently, the ultrasonic probe shown in FIG. 3 also has the same resonant frequency f as that of the ultrasonic probe shown in FIG. 2.

As stated above, the λ/4 resonance mode probe can transit and receive ultrasonic waves having the same frequencies, using a transducer which is half as thick as that used in the λ/2 mode. Thus, where, as in the case of high molecular piezoelectric material, it is impossible to form such a thick transducer due to difficulty in manufacturing, the λ/4 resonance mode is often employed. On the contrary, where, as in the case of a ceramic piezoelectric transducer, it is impossible to manufacture such a thin transducer, the λ/2 resonance mode is more advantageously adopted.

In summary, as clearly seen in the comparison of FIGS. 2 and 3, even though the thickness of the piezoelectric transducer materials are the same, the case of the λ/2 resonance mode and the case of the λ/4 resonance mode which has on the back surface of the acoustic reflecting layer 85 an acoustic impedance higher than that of the piezoelectric material differ completely from each other in respect of the resonant frequency. In the λ/2 resonance mode the piezoelectric material resonates at a frequency twice as high as that in the λ/4 resonance mode to transmit and receive ultrasonic waves. The illustrative embodiment of the present invention shown in FIG. 1 is a combination of the structures shown in FIGS. 2 and 4 to form the acoustic reflecting layer 85 shown in FIG. 4 into an annular shape as shown in FIG. 1A.

Figure 5:
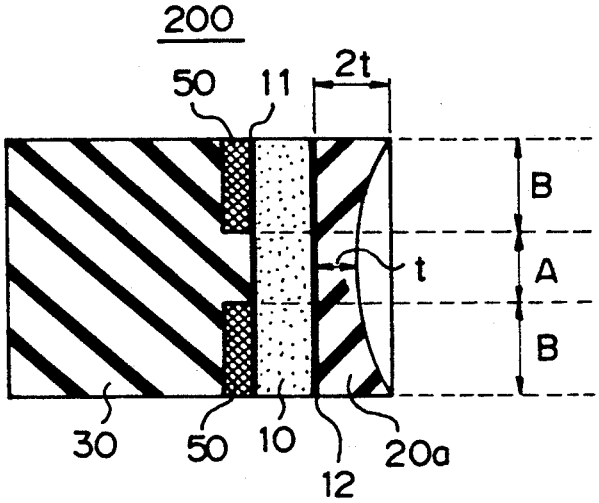
FIG. 5 is a sectional view, similar to FIG. 1, illustrating an alternative embodiment of the ultrasonic probe of the present invention.
Figure 6:
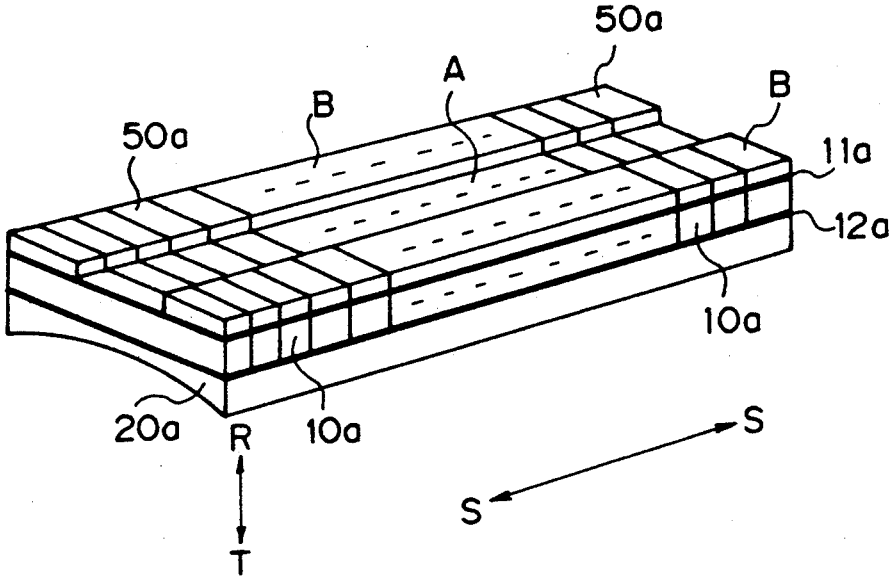
FIG. 6 is a perspective view exemplifying an array of the ultrasonic probe in accordance with the present invention.

FIGS. 5 and 6 show alternative embodiments of the ultrasonic probe involved in the present invention. An illustrative embodiment shown in FIG. 5 relates to an acoustic matching layer 20*a*, wherein the circumferential area B for the λ/4 resonance mode is formed to be twice as thickly as the center area A for the λ/2 resonance mode to accomplish good transmission of frequencies having longer wavelength in the circumferential area B and frequencies having shorter wavelength in the center area A and the vicinity thereof.

An illustrative embodiment shown in FIG. 6 is an array type of ultrasonic probe, wherein piezoelectric transducers 10*a* are arranged in the form of a linear array. In the direction perpendicular to the scanning direction S—S, i.e. the longitudinal direction toward the respective transducers 10*a*, provided on the center portion A of the back surface are backing materials, not shown, and formed on the back surface near both of the edge portions B are acoustic reflecting layers 50*a*. The piezoelectric transducers 10*a*, the backing materials, and the acoustic reflecting layers 50*a* have similar functions to those of the piezoelectric material 10, the backing material 30, and the acoustic reflecting layers 50, respectively, while their shapes are not cylindrical but generally rectangular as shown in the figure. To avoid complexity in FIG. 6, a backing material is not shown. Further, the acoustic matching layer 20*a*, similar to an embodiment shown in FIG. 5, is designed to have such a thickness that the more central portions of the matching layer 20*a* can better transfer the ultrasonic waves of higher frequency.

An array type ultrasonic probe shown in FIG. 6, in the longitudinal direction toward the respective transducers 10*a*, can transmit and receive near the center portion A frequencies having twice as high as those near both edge portions B. For example, when a probe is so designed as to selectively resonate near both end portions B at the frequency of 3.5 MHz which has been mainly used so far for the abdomen of the human body, in the vicinity of the center portion A the probe can obtain a doubled resonant frequency as high as 7 MHz which is effective for diagnosis of the shallower regions of the living body, such as the mammary gland, etc.

Figure 7A:
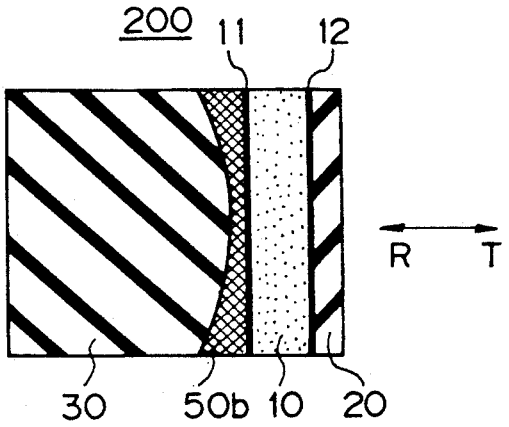
FIGS. 7A and 7B are a sectional view and a lateral view, similar to FIGS. 1A and 1B, respectively, showing another alternative embodiment of the present invention.
Figure 7B:
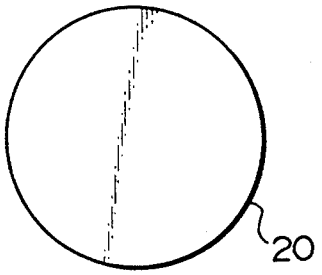

In FIGS. 7A and 7B, there are shown alternative embodiments of the ultrasonic probe 200 of the present invention, comprising a generally disc-shaped piezoelectric material 10. In the figures, similar components or structural elements are designated by the same reference numerals, and redundant description will be avoided for simplicity. Provided on one main surface of the piezoelectric material 10 is an electrode 12 brought in contact with an acoustic matching layer 20. Provided on the other main surface is an electrode 11 supported by a backing material 30 which, in the illustrative embodiment of the present invention, includes an acoustic reflecting layer 50*b*. The piezoelectric material 10 is an electric acoustic transducer material which, in response to an electric signal applied between both electrodes 11 and 12, generates ultrasonic waves and, in response to the ultrasonic waves received thereby, generates an electrical signal associated therewith.

The acoustic reflecting layer 50*b* has a plane surface on the adjacent side of the piezoelectric material 10, while in the direction of receiving ultrasonic waves T-R the surface is not flat but forms a concave surface so as to make the thickness gradually thinner from the circular peripheral portion toward the center portion. As previously stated, if without using the acoustic reflecting layer 50*b* the backing material 30 should be acoustically connected directly to the piezoelectric material 10, the piezoelectric material 10 would be in the λ/2 resonance mode. In the illustrative embodiment, however, as the acoustic reflecting layer 50*b* has been provided in the manner as stated above, the piezoelectric material 10 has the λ/4 resonance mode. The fact that when the thickness of the acoustic reflecting layer 50*b* is continuously varied, the resonant frequency of the piezoelectric material 10 varies accordingly has been recognized by the detailed simulation in the literatures published by the inventors and their group; K. Yamaguchi et al "New Method of Time Domain Analysis of the Performance of Multi-Layered Ultrasonic Transducers" IEEE Trans. on Ultra. Ferro. and Freq. Cont. Vol. UFFC-33, No. 6 (November 1986).

Figure 8:
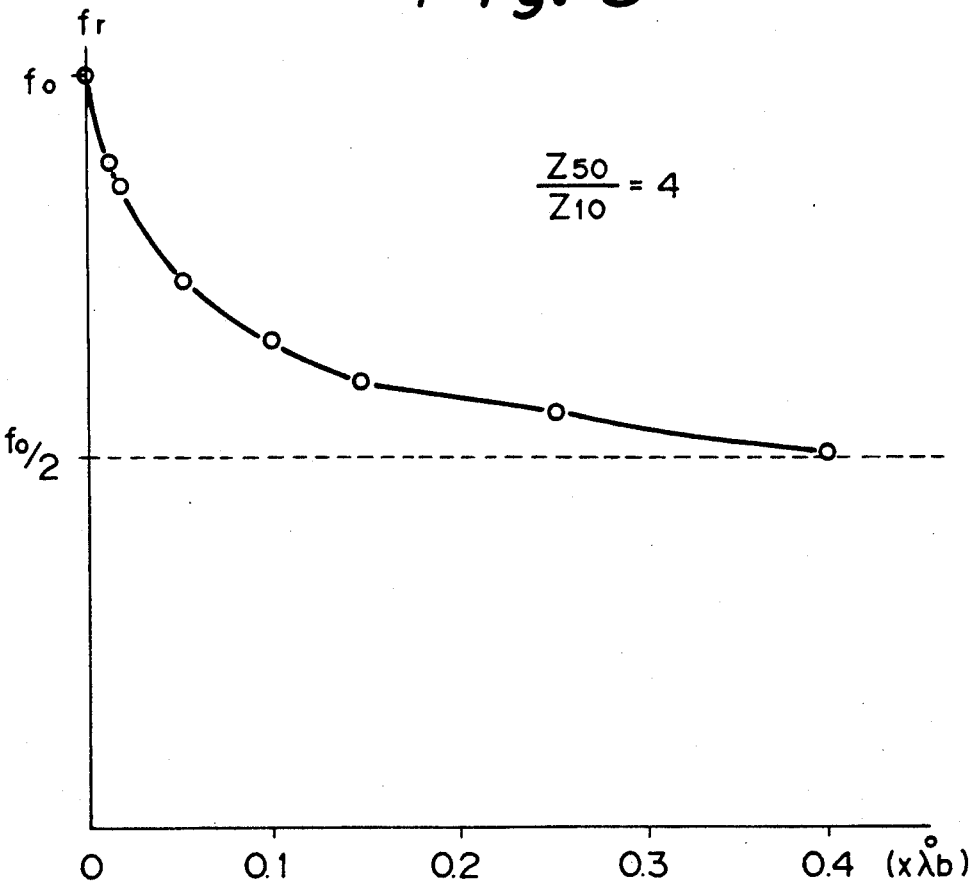
FIG. 8 is a graph plotting frequency characteristics of the embodiment of the present invention.

In the illustrative embodiment of the present invention, the probe 200 is constructed in a method according to the literatures. FIG. 8 plots the properties of the probe. It is understandable that when the thickness of the acoustic reflecting layer 50*b* is varied in a range of 0–0.4λ ob, the resonant frequency of the piezoelectric material 10 varies in a range of fo–fo/2. Where, λ ob is a wavelength of the frequency fo included in the acoustic reflecting layer 50*b* and is representative of a case where the acoustic impedance ratio $Z_{50}/Z_{10}$ for the acoustic reflecting layer 50*b* and the piezoelectric material 10 is equal to 4. In addition, the acoustic impedance and the thickness of the acoustic matching layer 20 have been selected to establish the maximum sensitivity. In this case, however, the sensitivity is based on the definition given in the literatures previously listed.

Figure 9:
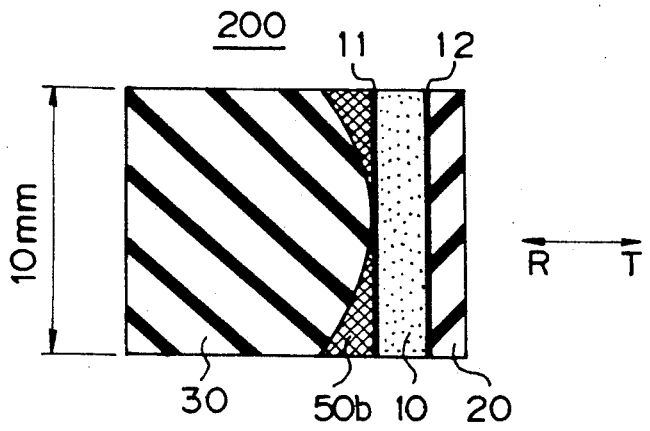
FIG. 9 is a sectional view illustrating a specific construction of the ultrasonic probe of the present invention.
Figure 10:
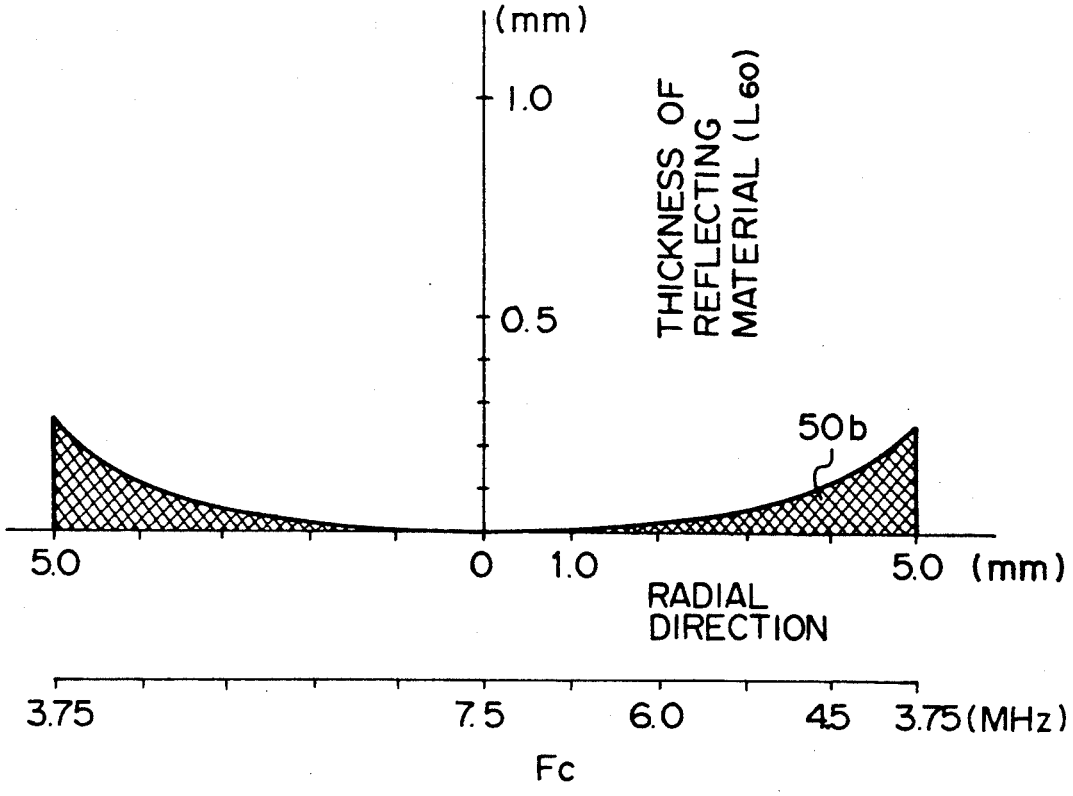
FIG. 10 is a graph showing characteristics of a reflector of the ultrasonic probe shown in FIG. 9.

Based on the results of analysis shown in FIGS. 7A and 8, an illustrative embodiment of the ultrasonic probe 200 is shown in FIG. 9. In the figure, the same reference numerals as those shown in FIG. 7 are used for indicating similar elements. Also, the sectional view of the acoustic reflecting layer 50*b* is shown in FIG. 10. In the illustrative embodiment, the central frequency fo is 7.5 MHz, the reflecting material 50 uses a copper (Cu) plate (Vb=5000 m/s, Zb=$45\times10^6$ kg/m$^2$s), and a sectional shape, when Zt/Zb=4, toward the radial direction from fo (the center portion) is shown. As seen in the figure, since the thickness of the reflecting layer 50 has been designed to be gradually thinner from the circumferential portion toward the center portion, the resonant frequency is, according to the thickness, distributed in a range of 7.5–3.75 MHz.

Figure 11:
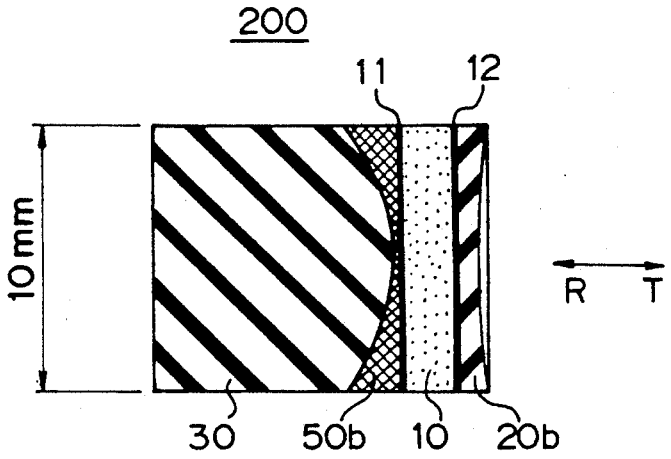
FIG. 11 is a sectional view, similar to FIG. 9, illustrating a specific construction of an alternative embodiment of the present invention.
Figure 12:
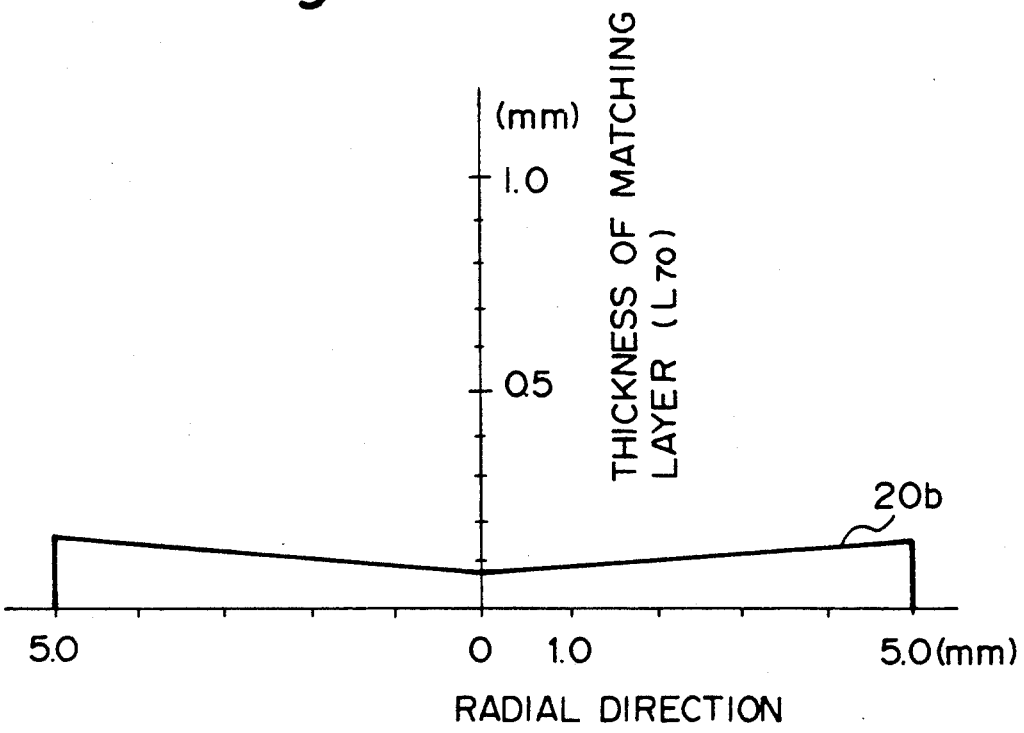
FIG. 12 is a graph, similar to FIG. 10, showing characteristics of an acoustic matching plate of the probe shown in FIG. 11.

FIG. 11 shows an embodiment in which the maximum sensitivity is provided for the probe 200 illustrated in FIG. 9. By forming the acoustic matching layer 20*b* into a sectional shape as shown in FIG. 12 and selecting resin (Vm=2500 m/s, Zm=$3\times10^6$ kg/m$^2$s) for the material, the maximum sensitivity can be obtained. In other words, in the illustrative embodiment the thickness in the frontal direction of the acoustic matching layer 20*b* has been formed to be linearly thinner from the circumferential portion of the piezoelectric material 10 toward the center portion thereof.

Figure 13:
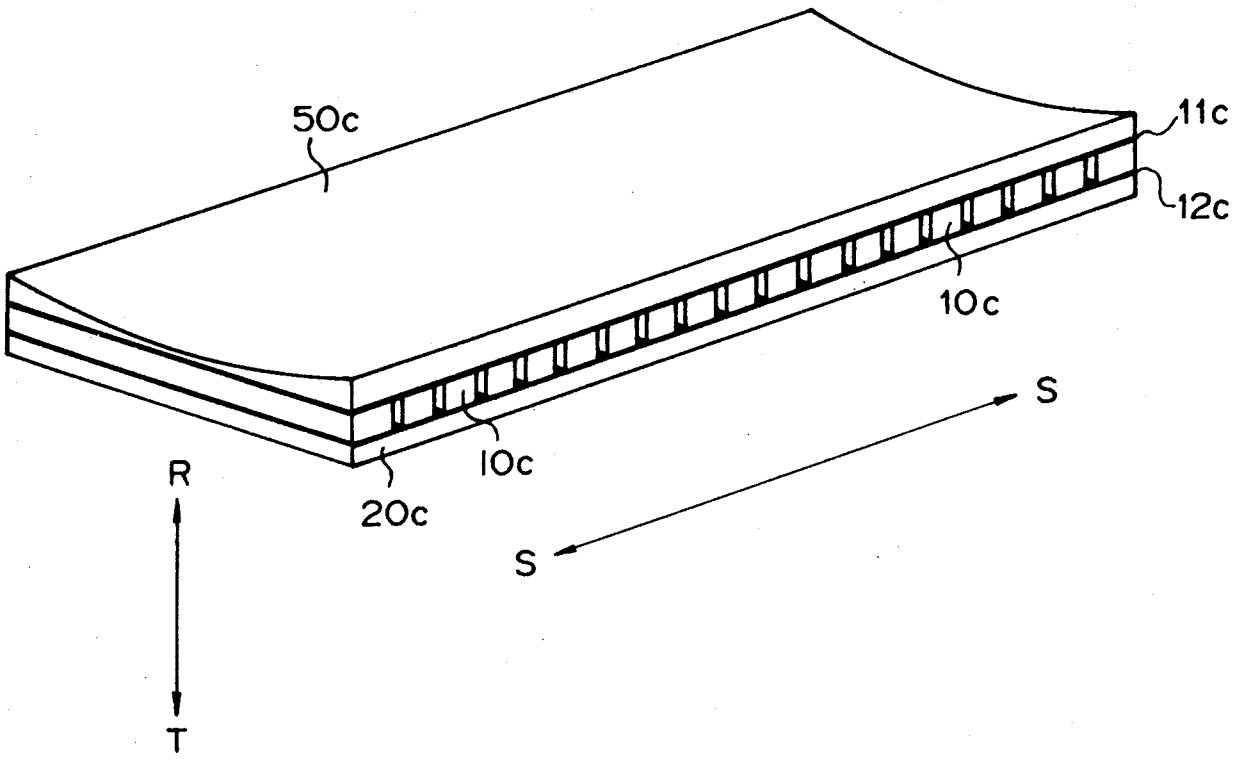
FIGS. 13 and 14 are perspective views, similar to FIG. 6, illustrating appearances of array types of probe of other alternative embodiments of the present invention.
Figure 14:
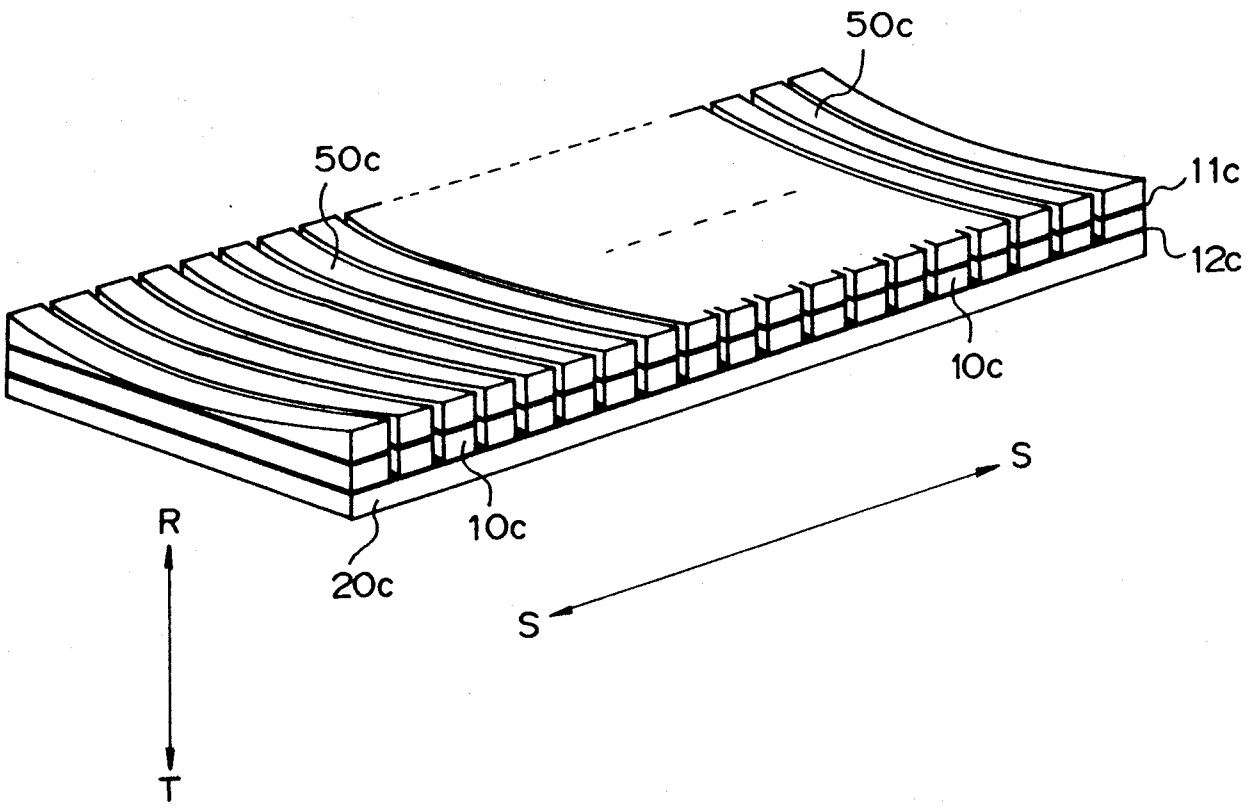

FIG. 13 shows an illustrative embodiment in which the present invention has been applied in an array type of probe. In the ultrasonic beam scanning direction S—S, provided on both surfaces of the bodies of piezoelectric material 10 are an acoustic matching layer 20*c* and a reflecting layer 50*c* as shown in the figure. The illustrative embodiment is similar to that shown in FIG. 9 except that the reflecting layer 50*c* formed into a concave shape and extending in the longitudinal direction of the array causes the bodies of piezoelectric material 10*c* to resonate in the resonance mode of $\lambda/2$–$\lambda/4$. This effectively enables ultrasonic survey in various depths to be executed. Ultrasonic beam is transmitted and received in an arrowed direction R-T. In FIG. 14, the array type probe shown in FIG. 13 is provided with the reflecting layer 50*c* split to be associated with the respective piezoelectric bodies 10*c*. As seen in the figure, the reflecting layer 50*c* can be easily manufactured and an array type probe in a desirable size may be designed.

As described so far, in accordance with the embodiments of the present invention, since the thickness of the reflecting plate is different over the entire area thereof, an ultrasonic probe may be provided and easily manufactured in which the resonance modes are, without being confined to resonant frequencies specific to respective transducers, continuously distributed in a range of $\lambda/2$–$\lambda/4$. In addition, the present invention is applicable effectively to ultrasonic probes of other types, such as a linear array type of probe, a sector type of probe, a convex type of probe, etc.

Figure 15:
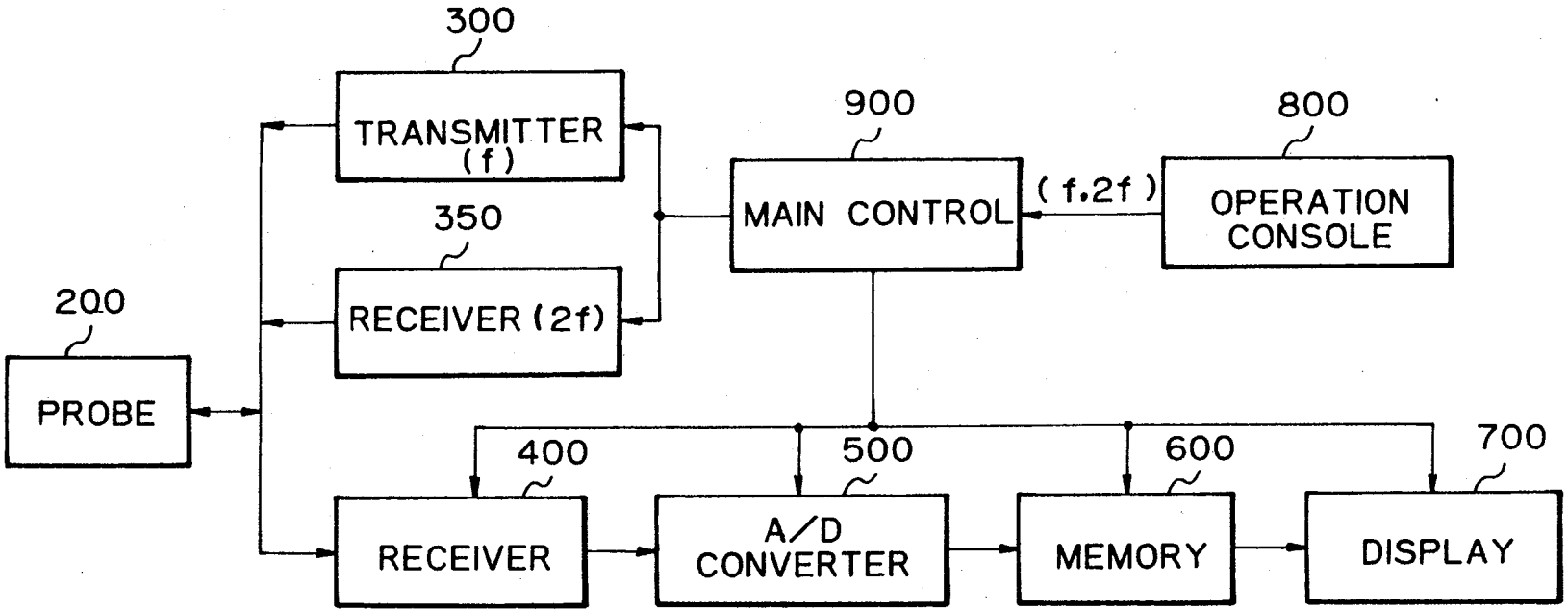
FIGS. 15 and 16 are schematic block diagrams showing the illustrative embodiments of an ultrasonic diagnostic apparatus using the ultrasonic probe in accordance with the present invention.
Figure 16:
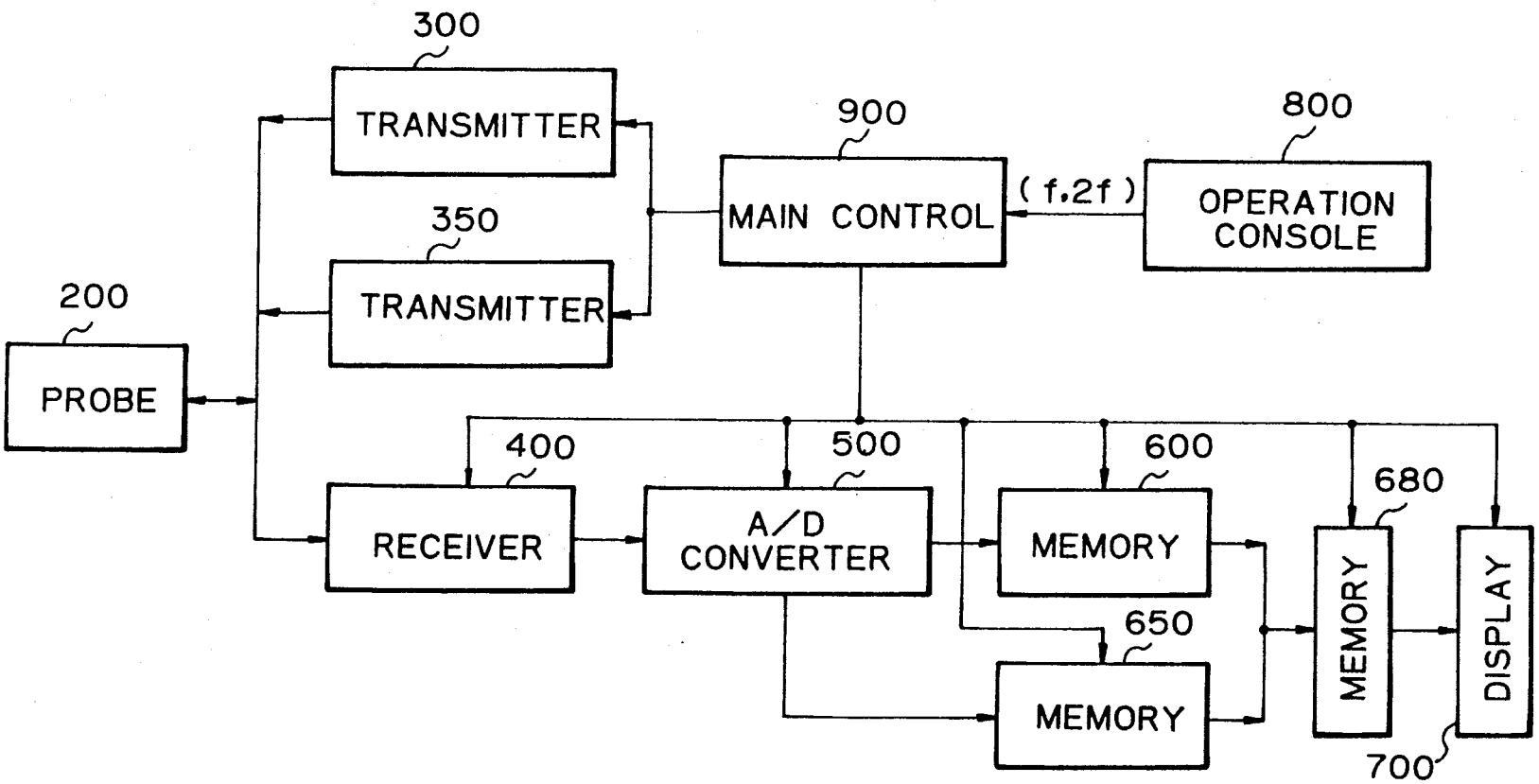

FIGS. 15 and 16 show illustrative embodiments of an ultrasonic diagnostic apparatus including an ultrasonic probe embodied by the present invention. In FIG. 15, a probe 200 has two resonant frequencies f and 2f connected to transmitters 300 and 350, respectively. The transmitters 300 and 350 are circuits for forming either of two resonant waveforms included in the probe 200. The apparatus comprises an operation console 800 used for receiving operator instructions from an operator to generate operation signals associated therewith for, specifically, selecting in response to an input operation by the operator either of the frequencies f and 2f which is suitable for examining a subject region, for example. The operation console 800 is connected to a main control 900 which, according to an operation command received by the operation console 800, controls operations of the respective circuits included in the apparatus. For example, when a frequency is selected on the operation console 800, the main control 900 causes the transmitters 300 and 350 associated with that frequency to operate. As a result, from the probe 200 ultrasonic waves having the selected frequency are transmitted.

Also, connected to the probe is a receiver 400 which is a circuit for receiving an echo from a subject to be examined. The receiver 400 is connected to an analog-to-digital (A/D) converter 500 which is a circuit for converting signals received in the receiver 400 into associated digital signals. The digital signals are in turn stored in a memory 600, and data stored in the memory 600 are developed in the form of a tomographic image on a display 700.

The receiver 400 may be implemented in the form of a broad-banded circuit having a receiving characteristic agreeable to the couple of frequencies f and 2f. For an alternative means, two discrete receiver agreeable to both frequencies may be prepared to use, in response to a command from the main control 900, for selecting one of the circuits having the frequency characteristics suitable to both receivers.

The illustrative embodiment shown in FIG. 16 has a plurality of memories 600, 650, and 680 to obtain tomographic images having the respective frequencies and compositely process those tomographic images for display. In operation, firstly the receiver 300 is driven to cause the probe 200 to transmit ultrasonic waves having a frequency f, and then over the receiver 400 and the A/D transducer 500 tomographic data of the deeper regions of a subject are stored in the memory 600. Similarly, the transmitter 350 is driven to cause the probe 200 to transmit ultrasonic waves having the other frequency 2f, and then the receiver 400 captures tomographic data of the shallower regions of the subject to store it in the memory 650 through the A/D transducer 500. Subsequently, the two kinds of tomographic data stored in the memories 600 and 650 are compounded into a complete set of tomographic data, and resultant data will be stored in the memory 680 later on to be developed on the display 700. In this way, for the shallower regions tomographic images are collected in terms of echoes having a higher frequency 2f while for the deeper regions in terms of echoes having a lower frequency f to obtain tomographic images having respective frequencies suitable to the depths of the regions of the subject of interest. By compounding those tomographic images, a single tomographic image will be developed on the display 700.

In addition, it is a matter of course that the present invention, without being restricted by the aforementioned embodiments, may be changed or modified variously within the scope and spirit of the present invention. In the illustrative embodiments, included in the circumferential area is an acoustic reflecting layer having a higher acoustic impedance and included in the center area and the vicinity thereof is a backing material having a lower acoustic impedance, for example, while the probe may not be divided into the central and circumferential areas but into right and left half areas, for example. Further, similar to the illustrative embodiment shown in FIG. 16, when respective tomographic images are compounded to be developed on a display, the display field may be divided or the field may be provided with a window to display both of the tomographic images side by side or in the form of an overlapped, single image. Still further, for storing data of tomographic images three memories are included in the structure shown in the illustrative embodiment, while the apparatus may be adapted to include a couple of image memories in which one of the pair of image data is written over the other to obtain a single tomographic image. Alternatively, when a single memory is adapted to store data first, followed by arithmetic processing executed with the data thus stored to obtain a single tomographic image.

As clearly read in the description so far, in accordance with the present invention, a single ultrasonic probe has a backing body provided for a piezoelectric transducer material and acting as part of the load, and improved into a specific arrangement to establish both of $\lambda/2$ and $\lambda/4$ resonance modes existing simultaneously. This enables the ultrasonic probe to be easily manufactured and implemented to include therein a broad frequency band with improved characteristics. Yet, ultrasonic tomographic images will be obtained with a good resolution and a good S/N ratio over a variety of depths in a subject to be studied.

Further in accordance with the present invention, since a single unit of ultrasonic probe can obtain a tomographic image having two different frequencies, the use of the characteristical difference of echo signals to different frequencies makes it possible to execute processing, such as tissue characterization (TC). Also, attenuation coefficient of tissue can be obtained, for example. Consequently, discrimination between normal and abnormal tissue including cancer tissue becomes possible.

Still further, in accordance with the present invention, by designing a backing material or a reflecting material of a transducer to have uneven thickness, an ultrasonic probe capable of transmitting and receiving ultrasonic waves having a broad bandwidth in the resonance mode from a $\lambda/2$ mode to a $\lambda/4$ mode can be realized. As a result, in all the depths of a subject to be diagnosed an ultrasonic tomographic image having high resolution and S/N ratio can be obtained. Besides, the probe has comparatively less difficulties in manufacture and a wide range of applications.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What we claim is:

1. An ultrasonic probe comprising:

a layer of piezoelectric material having generally flat main surfaces;

a pair of electrodes provided on said main surfaces of said layer of piezoelectric material to apply voltage to said layer of piezoelectric material;

a layer of backing material provided on one of said pair of electrodes and having an acoustic impedance lower than that of said piezoelectric material; and a layer of reflecting material interposed between said one electrode and said layer of backing material, said reflecting material having an acoustic impedance higher than that of said layer of piezoelectric material, and having a first portion and a second portion thinner than said first portion.

2. An ultrasonic probe in accordance with claim 1, wherein the second portion is formed near a center of said layer of reflecting material, and the first portion is formed on a periphery of the second portion.

3. An ultrasonic probe in accordance with claim 1, wherein said first and second portions have a thickness continuously varying from a periphery to a center thereof.

4. An ultrasonic probe comprising:

a layer of piezoelectric material having generally flat main surfaces;

a pair of electrodes provided on said main surfaces of said layer of piezoelectric material to apply voltage to said layer of piezoelectric material;

a layer of backing material provided on one of said pair of electrodes and having an acoustic impedance lower than that of said layer of piezoelectric material;

a layer of reflecting material interposed between said one electrode and said layer of backing material, said reflecting material having an acoustic impedance higher than that of said layer of piezoelectric material, said layer of reflecting material including a first portion and a second portion which is thinner than the first portion; and a layer of acoustic matching material formed on another of said pair of electrodes, and including a periphery portion and a center portion which is thinner than the periphery portion.

5. An array type of ultrasonic probe comprising a plurality of ultrasonic probe elements arranged in the form of an array, wherein each of said ultrasonic probe elements comprises includes:

a layer of piezoelectric material having a generally rectangular shape and generally flat, opposite main surfaces;

a pair of electrodes provided on said main surfaces of said layer of piezoelectric material to apply voltage to said layer of piezoelectric material;

a layer of backing material provided on one of said pair of electrodes and having an acoustic impedance lower than that of said layer of piezoelectric material, said plurality of ultrasonic probe elements having said layer of backing material extending in a common direction substantially perpendicular to a longitudinal direction of the generally rectangular shape; and a layer of reflecting material interposed between said one electrode and said layer of backing material, and having an acoustic impedance higher than that of said layer of piezoelectric material, and said layer of reflecting material including a first portion and a second portion which is thinner than the first portion.

6. An array type of ultrasonic probe in accordance with claim 5, wherein the second portion is formed near a center of said layer of reflecting material, and the first portion is formed on a periphery of the second portion.

7. An array type of ultrasonic probe in accordance with claim 5, wherein the first and second portions continuously vary in thickness over both portions.

8. An array type of ultrasonic probe in accordance with claim 5, wherein the second portion has a thickness of substantially zero to allow said layer of backing material to be in partial contact with said one electrode.

9. An array type of ultrasonic probe in accordance with claim 8, wherein the second portion is formed near a center of said layer of reflecting material, and the first portion is formed on a periphery of the second portion.

10. An ultrasonic diagnostic apparatus comprising:

an ultrasonic probe transducing electric signals and ultrasonic waves to each other;

transmitter means for feeding electric signals to said ultrasonic probe to transmit ultrasonic waves;

receiver means for receiving electric signals generated from said ultrasonic probe;

image visualizing means for producing images represented by the electric signals received in said receiver means wherein said ultrasonic probe includes:

a layer of piezoelectric material having generally flat main surfaces;

a pair of electrodes provided on said main surfaces of said layer of piezoelectric material to apply voltage to said layer of piezoelectric material;

a layer of backing material provided on one of said pair of electrodes and having an acoustic impedance lower than that of said layer of piezoelectric material; and a layer of reflecting material interposed between said one electrodes and said layer of backing material and having an acoustic impedance higher than that of said layer of piezoelectric material, said layer of reflecting material including a first portion and a second portion which is thinner than the first portion;

said transmitter means further generating electric signals having a plurality of frequencies to feed the signals to said ultrasonic probe:

said image visualizing means further including:

image combining means for combining said images having said plurality of frequencies; and image display means for visualizing an image combined by said image combining means.

11. An ultrasonic diagnostic apparatus in accordance with claim 10, wherein said transmitter means comprises a plurality of transmitters, each of which generates an electric signal at different one of the plurality of frequencies.

12. An ultrasonic diagnostic apparatus comprising:

an ultrasonic probe transducing electric signals and ultrasonic waves to each other;

transmitter means for feeding electric signals to said ultrasonic probe to transmit ultrasonic waves;

receiver means for receiving electric signals generated from said ultrasonic probe;

image visualizing means for producing a plurality of first images or a second image represented by the electric signal received in said receiver means; wherein said ultrasonic probe includes:

a layer of piezoelectric material having generally flat main surfaces;

a pair of electrodes provided on said main surfaces of said layer of piezoelectric material to apply voltage to said layer of piezoelectric material;

a layer of backing material provided on one of said pair of electrodes and having an acoustic impedance lower than that of said layer of piezoelectric material; and a layer of reflecting material interposed between said one of said electrodes and said layer of backing material and having an acoustic impedance higher than that of said layer of piezoelectric material;

said layer of reflecting material including a first portion and a second portion which is thinner than the first portion;

said transmitter means further generating electric signals having a plurality of frequencies to feed the signals to said ultrasonic probe;

said image visualizing means further including:

image combining means for combining said plurality of first images having the plurality of frequencies; and image display means for displaying said second image combined by said image combining means; wherein said image combining means includes:

a plurality of first storage means, each of which stores therein first electric signals representative of said first image associated with a different one of the plurality of frequencies;

second storage means interconnected to said plurality of first storage means in which said plurality of said first images represented by a plurality of said first electric signals stored in said plurality of first storage means are combined; and control means interconnected to said plurality of first storage means and said second storage means for storing in said second storage means second electric signals representative of said second image produced by combining said plurality of first images represented by the plurality of first electric signals stored in said plurality of first storage means;

said image display means being controlled by said control means for reading said second electric signals out of said second storage means to develop said second image.

* * * * *